US006055688A

United States Patent [19]

Helmsderfer et al.

[11] Patent Number: 6,055,688

[45] Date of Patent: May 2, 2000

[54] BABY DIAPER CHANGING STATION WITH HIDDEN HINGE STRUCTURE

[75] Inventors: John A. Helmsderfer, 2151 Luray Ave., Cincinnati, Ohio 45206; David Memke, Cincinnati, Ohio

[73] Assignee: John A. Helmsderfer, Cincinnati, Ohio

[21] Appl. No.: 09/039,996

[22] Filed: Mar. 17, 1998

[51] Int. Cl.[7] ..... A47C 17/40; A47D 7/00

[52] U.S. Cl. ..... 5/655; 5/136; 5/947

[58] Field of Search ..... 5/136, 133, 655, 5/947, 424; 312/248, 242, 246; 108/42, 38

[56] References Cited

U.S. PATENT DOCUMENTS

| | | | |
|---|---|---|---|
| D. 179,871 | 3/1957 | Wrablica, Jr. | D33/19 |
| D. 243,048 | 1/1977 | Touchett et al. | D6/132 |
| D. 243,213 | 2/1977 | Kormos | D6/14 |
| D. 246,682 | 12/1977 | Nakao | D6/7 |
| D. 248,805 | 8/1978 | Bridges | D6/136 |
| D. 249,991 | 10/1978 | Bridges | D6/136 |
| D. 250,800 | 1/1979 | Trossman | D6/132 |
| D. 251,039 | 2/1979 | Reppas | D6/4 |
| D. 255,734 | 7/1980 | Liebman | D6/136 |
| D. 260,827 | 9/1981 | Sommer | D6/80 |
| D. 263,532 | 3/1982 | Ferdinand et al. | D6/178 |
| D. 265,703 | 8/1982 | Zaro | D6/574 |
| D. 267,843 | 2/1983 | Sundberg | D6/132 |
| D. 272,402 | 1/1984 | Marrujo | D6/199 |
| D. 274,105 | 6/1984 | Brescia et al. | D6/114 |
| D. 277,819 | 3/1985 | Crosslen | D6/396 |
| D. 283,189 | 4/1986 | Hampton | D6/574 |
| D. 284,530 | 7/1986 | Riehm | D6/384 |
| D. 284,531 | 7/1986 | Riehm | D6/384 |
| D. 284,723 | 7/1986 | Morris et al. | D6/560 |
| D. 287,200 | 12/1986 | Gecchelin | D6/574 |
| D. 287,318 | 12/1986 | Garduno | D6/429 |
| D. 293,403 | 12/1987 | Umanoff et al. | D6/555 |
| D. 293,404 | 12/1987 | Murphy | D6/574 |
| D. 294,096 | 2/1988 | Murphy | D6/560 |
| D. 295,007 | 4/1988 | Hardy et al. | D6/555 |
| D. 299,687 | 2/1989 | Handler et al. | D6/574 |
| D. 302,088 | 7/1989 | Burt | D6/555 |
| D. 312,185 | 11/1990 | Prater, Sr. | D6/574 |
| D. 313,516 | 1/1991 | Socher | D6/384 |
| D. 314,112 | 1/1991 | Dainty | D6/555 |
| D. 314,486 | 2/1991 | Day | D6/555 |
| D. 318,307 | 7/1991 | Hahn et al. | D6/390 |
| D. 322,531 | 12/1991 | Hobson | D6/574 |
| D. 325,309 | 4/1992 | Worrell | D6/509 |
| D. 325,826 | 5/1992 | Brunner et al. | D6/397 |
| D. 326,384 | 5/1992 | Burt et al. | D6/555 |
| D. 327,786 | 7/1992 | Ferrell | D6/397 |
| D. 329,950 | 10/1992 | Takahashi et al. | D6/392 |
| D. 332,197 | 1/1993 | Chase | D6/555 |
| D. 333,389 | 2/1993 | Saito et al. | D6/356 |
| D. 333,923 | 3/1993 | Dainty | D6/333 |

(List continued on next page.)

FOREIGN PATENT DOCUMENTS

| | | | |
|---|---|---|---|
| 505341 | 8/1930 | Germany | 5/136 |

*Primary Examiner*—Alexander Grosz
*Attorney, Agent, or Firm*—Wood, Herron & Evans, LLP

[57] ABSTRACT

A wall-mounted station for changing the diapers of a baby comprises a base configured for being vertically mounted to a wall and defining a base plane and a baby platform hingedly mounted to the base and defining a platform plane. The baby platform is operable for being movable between an opened position wherein the platform plane is disposed generally perpendicular to the base plane for the platform to receive a baby and a closed position wherein the platform plane is generally parallel to the base plane. A stop structure extends from a rear edge of the baby platform proximate the base and generally perpendicular to the platform plane. A mounting pad is positioned on the base and is disposed generally parallel to the base plane. The stop structure is operable for abutting against the mounting pad when the baby platform is moved to an open position to support the platform and maintain the baby platform perpendicular to the base when the weight of a baby is placed thereon.

5 Claims, 7 Drawing Sheets

U.S. PATENT DOCUMENTS

| | | | |
|---|---|---|---|
| D. 336,192 | 6/1993 | Wedeking | D6/511 |
| D. 338,110 | 8/1993 | Peay | D6/333 |
| D. 344,869 | 3/1994 | Paradis et al. | D6/555 |
| D. 378,966 | 4/1997 | Helmsderfer | D6/555 |
| D. 391,794 | 3/1998 | Helmsderfer | D6/555 |
| 2,174,363 | 9/1939 | Eubank . | |
| 2,735,737 | 2/1956 | Hancock | 5/947 |
| 3,656,193 | 4/1972 | Schneider et al. | 5/655 |
| 3,693,293 | 9/1972 | Egan, Jr. et al. | 49/56 |
| 4,074,635 | 2/1978 | Stauble | 108/27 |
| 4,125,192 | 11/1978 | Dayen | 211/14 |
| 4,133,063 | 1/1979 | Jones-Steele | 5/655 |
| 4,205,669 | 6/1980 | Hamann | 5/655 |
| 4,216,951 | 8/1980 | Griffin | 5/655 |
| 4,522,381 | 6/1985 | Ludwick | 5/655 |
| 4,527,830 | 7/1985 | Meyers | 297/192 |
| 4,613,996 | 9/1986 | Chase et al. | 5/947 |
| 4,633,789 | 1/1987 | Kortering et al. | 108/152 |
| 4,648,766 | 3/1987 | Wollar | 411/41 |
| 4,712,258 | 12/1987 | Eves | 5/655 |
| 4,723,493 | 2/1988 | Siani et al. | 108/134 |
| 4,788,726 | 12/1988 | Rafalko | 5/655 |
| 4,796,314 | 1/1989 | Garduno | 5/98.1 |
| 4,953,312 | 9/1990 | Astolfi | 40/156 |
| 4,965,896 | 10/1990 | Berger et al. | 5/947 |
| 4,972,532 | 11/1990 | Juan | 5/94 |
| 4,978,093 | 12/1990 | Kennedy | 248/205.1 |
| 5,072,979 | 12/1991 | Swinton | 293/128 |
| 5,081,724 | 1/1992 | Takahashi et al. | 5/136 |
| 5,084,927 | 2/1992 | Parkevich | 5/484 |
| 5,086,527 | 2/1992 | Takahashi et al. | 5/947 |
| 5,161,270 | 11/1992 | Najmabadi | 5/655 |
| 5,265,296 | 11/1993 | Abbas et al. | 5/488 |
| 5,707,126 | 1/1998 | Neufeld et al. | 312/242 |
| 5,754,999 | 5/1998 | Helmsderfer | 5/947 |
| 5,906,015 | 5/1999 | Hilger et al. | 5/655 |

BABY DIAPER CHANGING STATION WITH HIDDEN HINGE STRUCTURE

FIELD OF THE INVENTION

The present invention relates to an apparatus to be placed in a restroom for changing the diapers of an infant.

BACKGROUND OF THE INVENTION

Apparatuses for changing the diapers of a baby or "changing a baby" and other small children not yet toilet trained, have become widely used, such as in public restrooms, to assist a parent or other child supervisor when changing a baby's diapers. Such baby diaper changing apparatuses, oftentimes referred to as simply baby changing stations, have taken various forms as evidenced by patents in the field, and generally take the form of a base which is mounted vertically onto a surface of a wall and a support platform or surface which is hingedly mounted to the base to hinge down from the base and lie generally horizontal to support a baby. While available baby changing stations may operate sufficiently for the primary purpose of offering a surface on which to rest a baby during a diaper change, the currently available stations have various drawbacks and, specifically, do not difficult to adequately clean the stations. If the stations are not thoroughly cleaned, they accumulate dirt and thus will not be used by the facility's patrons. From a business standpoint, having a dirty baby changing station which is not used is generally a worse alternative than having no baby changing station at all.

The available stations use hinge structures which require various crevices and openings. Such hinge structures are necessary for supporting the baby platform. Therefore, they have been used despite cleaning issues because they are strong. Any attempts to reduce the crevices around the hinge structures of such baby changing apparatuses can only be done if the structural integrity of the apparatus is not jeopardized. That is, the support platform must remain sufficiently strong to support the weight of a baby or small child. Actually, the support platform must be able to support a weight significantly more than the weight of a small child.

Another drawback to conventional stations is the exposed hinge structures which may be seen both when the baby platform is up in a closed position and when the platform is down in the opened position. The hinge structures are very noticeable and thus detract from the appearance of the station. It is desirable to maintain the aesthetic appearance of the baby changing station within the restroom environment. The baby changing station must still be comfortable-looking and inviting to entice a parent to it.

The cost and operation of the baby changing station are also important factors to be considered. A facilities owner does not want to spend address the needs of facility owners who must maintain the restrooms or other facilities in which the baby changing apparatuses are mounted.

First, conventional stations are costly to clean and maintain and often are not adequately cleaned even when a thorough effort is made. Currently available baby changing stations utilize complicated hinge structures with multiple elements which are both exposed when the diaper changing platform or support platform is hinged down to a horizontal position to receive a baby, and when the platform is hinged up against the wall. The hinge structures create a large number of crevices and joints which trap dirt, diaper wipes, and other undesirable materials to which the upper surface or changing surface of the platform is exposed. When such material gets into and between the hinge structures, it is difficult to remove and thus creates an environment for germs. Cleaning personnel will generally not take the time necessary to clean in between the various cracks and crevices of the hinge structure to remove the material. Furthermore, even substantial efforts to do so may be unsuccessful due to the depths of the crevices. Dedicating cleaning personnel to such a difficult task removes them from other cleaning tasks and slows their efficiency, thus increasing the costs of cleaning and maintaining the facilities.

One alternative for a thorough cleaning is disassembly of the diaper changing station. With respect to available diaper changing stations, disassembly of the unit is generally not an option. Additionally, removing the unit from the wall for cleaning purposes is also undesirable. As such, facility owners who maintain the restrooms and the baby changing stations find it an exorbitant amount of money to purchase and maintain the changer. Therefore, the hinge structure securing the support platform to the base should operate without a large number of complicated, interconnecting parts which are subject to failure and breakage.

Accordingly, it is an objective of the present invention to enhance the cleanability of a baby diaper changing station and to reduce the accumulation of dirt and other undesirable material on the station.

It is a further objective of the invention to ensure that the support platform of the baby changing station is sufficiently strong to hold an amount of weight exceeding the weight of a normal small child.

It is an additional objective of the present invention to provide a baby changing station which is aesthetically pleasing to view, both opened and closed, and is inviting to a child care provider for use in changing a baby's diaper.

It is still another objective of the invention to reduce the purchase and maintenance costs of a baby diaper changing station while providing a durable and easily maintained station.

These objectives and other objectives are addressed by the present invention and are discussed further hereinbelow.

SUMMARY OF THE INVENTION

The present invention addresses the above objectives and other objectives by providing a wall-mounted station for changing the diapers of a baby which comprises a base configured for being vertically mounted to a wall and a baby platform hingedly mounted to a base to provide improved rigidity and support to the platform. In the opened position, the invention further eliminates various crevices proximate the platform trough in which the baby is changed which are existent in prior art stations, and thus provides easier cleaning of the platform. In the closed position, the station provides a smooth and aesthetically pleasing front surface which does not reveal any hinge structures. The elimination of hinge exposure in the closed position further provides a cleaner station which is less susceptible to trapping and containing bathroom dirt and germs. The support structures used in the present invention for supporting the baby platform provide improved rigidity to the platform, thus reducing sag.

To that end, the baby platform is hingedly mounted to the base and defines a platform plane. The platform is movable to an opened position where the platform plane is perpendicular to a base plane defined by the wall-mounted base. The platform is configured to receive a baby in the opened position. In the closed position, the platform is hinged up against the base such that the platform plane is generally parallel to the base plane. The support structures of the invention are configured such that, in the closed position, a smooth front surface is presented by the station which is more aesthetically pleasing than prior art stations which expose hinge structures. Furthermore, the smooth front surface is easier to clean and thus prevents the accumulation of dirt and germs which normally would collect in the hinge structures of prior art stations.

In accordance with one aspect of the present invention, the baby platform is rigidly supported from the base in the opened position by a series of stop structures which engage mounting pads on the base. More specifically, the stop structures extend upwardly from a rear edge of the baby platform which is positioned proximate the base when the platform and base are hingedly coupled together. The stop structures extend generally perpendicular to the platform plane. A series of mounting pads are formed on the base and are disposed generally parallel to the base plane. Thus when the platform is moved to the opened position so that the platform plane is perpendicular to the base plane, the stop structures will extend generally parallel to the base plane to engage the mounting pads and abut thereagainst. The abutting stop structures and mounting pads secure the opened platform in a generally horizontal position for receiving a baby thereon. The stop structures provide greater rigidity to the platform than has been achievable with prior art baby diaper changing stations utilizing conventional hinge structures. A metal pivot rod extends through the platform and base where they are hingedly coupled together and in combination with the various stop structures and mounting pads provides rigid, hinged securement of the platform to the base.

In accordance with another aspect of the present invention, the mounting pads on the base are defined by a forwardly extending lip which extends generally along the length of the base. The lip and mounting pads formed thereby abut against the stop structures, as mentioned above, such that when the platform is in the opened position the stop structures are generally completely hidden by the lip. Therefore, the lip extending generally along the length of the base eliminates many of the various cracks and crevices associated with prior art hinge structures and provides a smooth surface which may be easily cleaned, along with the upper surface or trough of the baby platform. Thus, the invention provides a sanitary improvement over the prior art. Furthermore, the easier cleaning of the inventive station reduces the cost of maintenance to the facility owner.

The inventive station is also more aesthetically appearing than prior art stations. The stop structures are hidden from view in the opened position thus creating a clean, smooth, and sleek look to the station. Furthermore, the stop structures are also hidden from view in the closed position. Since the stop structures extend perpendicularly to the platform, they will extend rearwardly on the base when the platform is closed against the base to provide a clean and smooth look to the front surface of the closed station.

An alternative embodiment of the present invention provides a baby platform which hinges away from the base at an end thereof so that the baby extends lengthwise away from the wall generally with its head proximate the wall and its feet away from the wall to be accessed for the diaper changing procedure. The platform for the alternative embodiment thus extends further away from the base and creates a greater downward force or moment on the platforn. Accordingly, the hinge structure used to couple the platform to the base utilizes a combination of the stop structures and mounting pads discussed hereinabove, as well as secondary mounting surfaces provided by portions of the base and platform which further secure the platform in the open position and thus reduce the sag or downward flex of the platform when a baby is placed thereon. When the platform is in the opened position, the secondary surfaces of the hinge structure are disposed generally parallel to the platform, whereas the stop structures and mounting pads are disposed generally perpendicular to the platform. The combination of perpendicular and parallel supporting surfaces in addition to the mounting rod provided by the invention create a very strong support structure for the platform to compensate for the increased moment forces thereon provided by its orientation at a greater distance from the wall.

BRIEF DESCRIPTION OF THE FIGURES

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
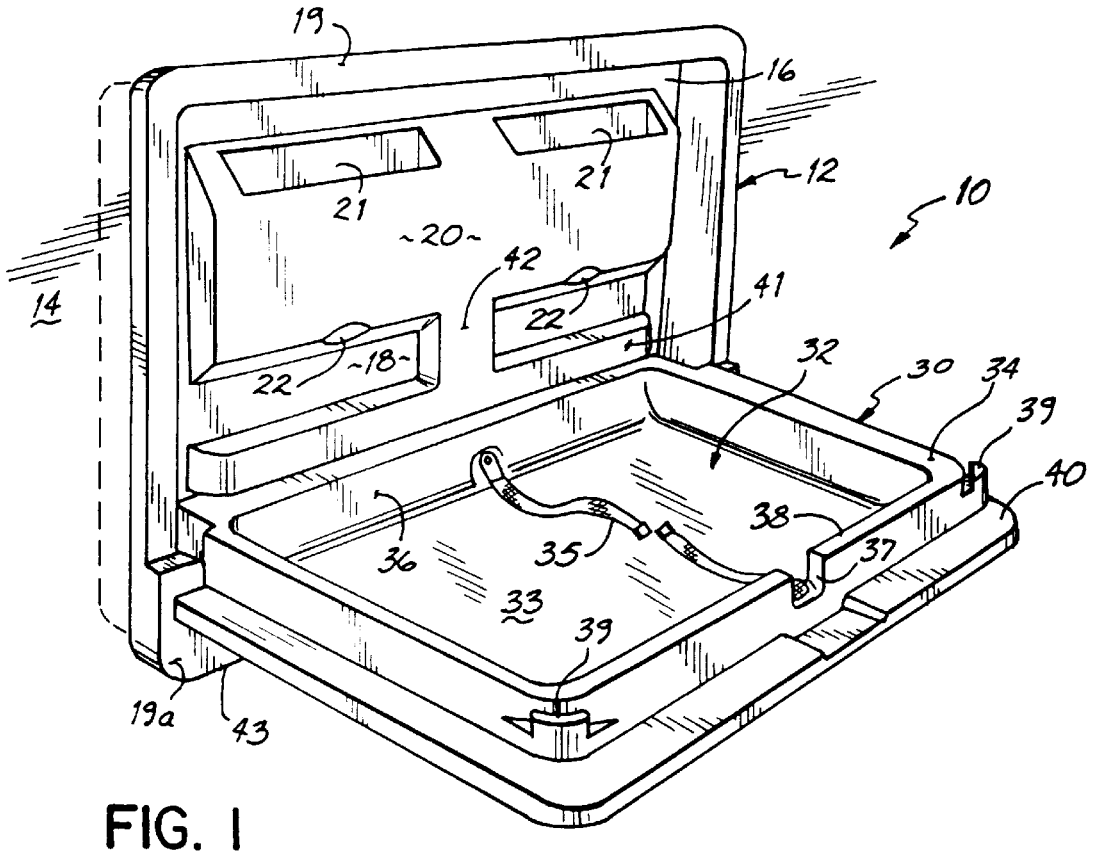
FIG. 1 is a perspective view of one embodiment of the diaper changing station of the present invention.

FIG. 1 shows a perspective view of one embodiment of the invention. Diaper changing station 10 includes a base 12 which is configured for being vertically mounted to a wall. Base 12 defines a base plane 13 (see FIG. 3A), and the base may be vertically mounted onto an appropriate wall surface 14 by bolts 15 or other appropriate fasteners (see FIG. 2). Base 12 forms a cavity 16 and includes a face surface 18. A flange 19 surrounds the periphery of the base. The base 12 has a defined depth "D" and may be either surface mounted on a wall or inset into the wall up to flange 19 so that the flange is flush against the wall.

For holding paper liners or towels to be utilized in the baby changing operation, base 12 includes a dual liner dispenser 20 with inlet openings 21 for loading liners therein, and outlet openings 22 for dispensing the liners. The liner dispenser 20 is raised forward from surface 18 a sufficient distance for forming cavities 23 in the dispenser for holding the liners (see FIGS. 5A and 5B).

Figure 1A:
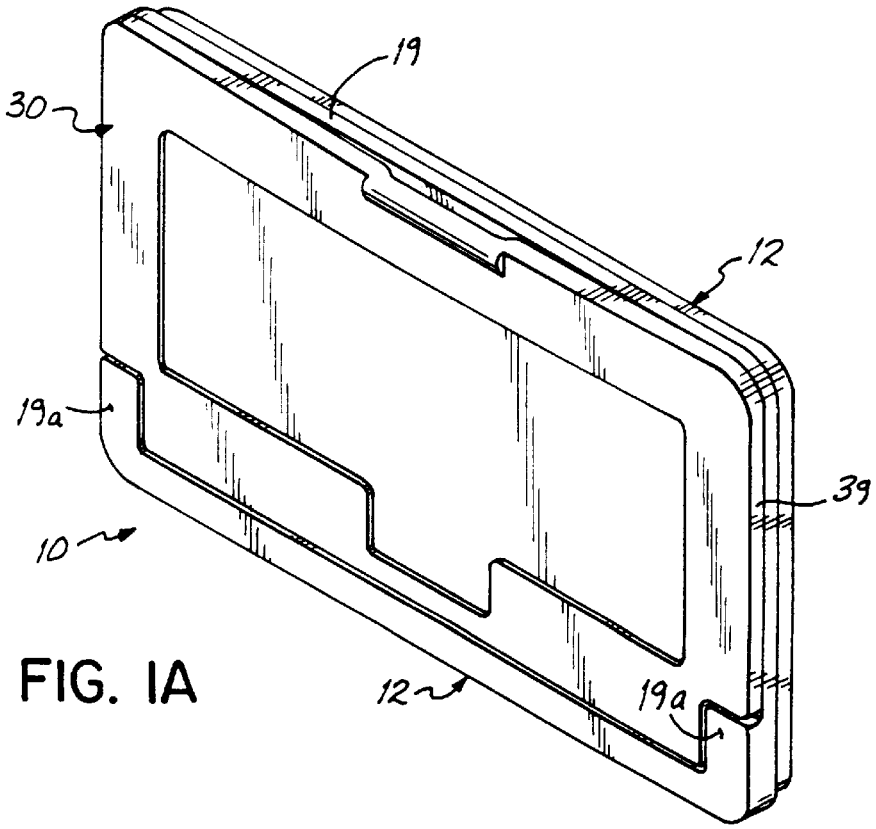
FIG. 1A is a front view of the embodiment illustrated in FIG. 1 with the platform in the closed position.
Figure 3A:
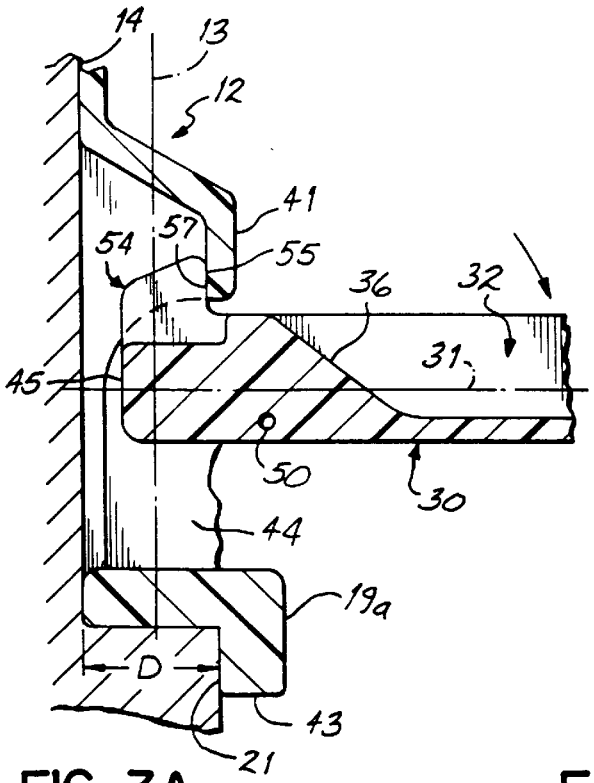
FIGS. 3A and 3B are cross-sectional views of FIG. 2 taken along lines 3—3, showing the platform in the opened and closed positions respectively.
Figure 3B:
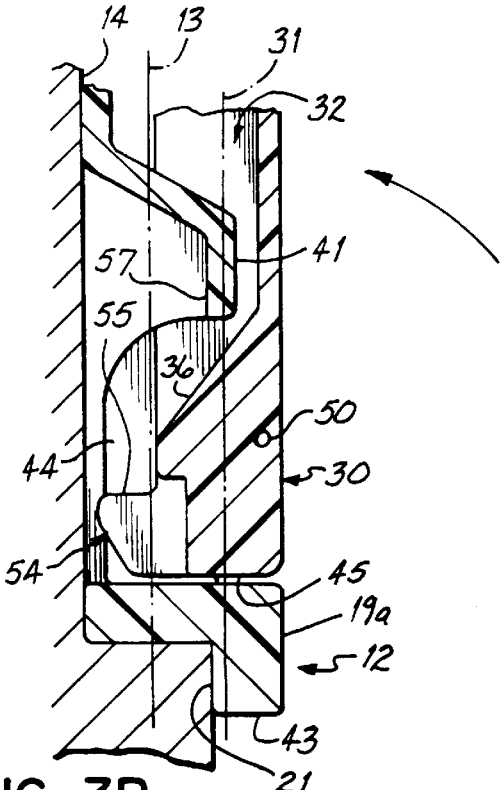

Hingedly mounted to base 12 is a support platform or baby platform 30 which defines a platform plane 31. The baby platform 30 is operable for being movable between an open position as illustrated in FIG. 1 wherein the platform plane 31 is disposed generally perpendicular to the base plane 13 (see FIG. 3A). The baby platform also has a closed position as illustrated in FIGS. 1A, 3B and 4B, wherein the baby platform is hinged up against the base 12 and the platform plane 31 is generally parallel to the base plane 13. Baby platform 30 includes a trough 32 which is configured to give a depth to the platform 30 for safely containing a baby who is to have its diapers changed thereon. The trough 32 is defined by a curved upper surface 33 which curves or slopes downwardly from a peripheral lip 34 of the platform to define the effective depth of the trough. A safety strap 35 is secured at both ends and is used to belt a baby into the trough 32. One end of the strap 35 is secured to the rear wall surface 36 of the trough. The other end of the strap is secured into a cutout 37 in the front wall 38 of the trough 32. The cutout 37 insures that the end of the strap will not interfere with base 12 when the baby platform 30 is moved to a closed position. Preferably, strap 35 is adjustable in length.

For securing diaper bags, purses, and other items during the diaper changing procedure, utility hooks 39 are formed in the front corners of baby platform 30 on the outside of trough 32. A flange 40 extends peripherally around the baby platform 30 and lies flush against flange 19 when the platform 30 is in the closed position. The base 12 and platform are molded of a suitable plastic material.

Extending forward of surface 18 on the base is a lip 41 which extends generally across a substantial portion of the length of base 12. Lip 41 forms and defines mounting pads for engaging various stop structures to hold baby platform 30 in an opened and generally horizontal position as discussed further hereinbelow. The raised lip 41 is generally continuous with the raised liner dispenser 20 and a cylinder cavity 42 which is formed for accommodating a cylinder for smooth opening and closing of the baby platform 30 (see FIGS. 4A and 4B). The raised liner dispenser 20, raised lip 41, and cylinder cavity 42 help to define the cavity 16 in base 12. The cavity has a depth from the flange 19 sufficient to receive the lip 34 of platform 30. Therefore, in a closed position, a portion of the baby platform 30 is recessed into the base 12 and the peripheral flanges 40 and 19 are generally disposed flush against each other, as shown in FIG. 1A.

Base 12 includes a slot portion or slot 44 formed proximate the bottom edge 43 of base 12. Referring to FIGS. 3A and 3B, slot 44 has sufficient depth to receive a rear edge 45 of platform 30 and provides sufficient room for pivoting movement of the edge 45 and platform 30 within the slot 44 so that the platform 30 may be moved between an opened and closed position, as illustrated in FIGS. 3A and 3B, and as discussed further hereinbelow.

Figure 2:
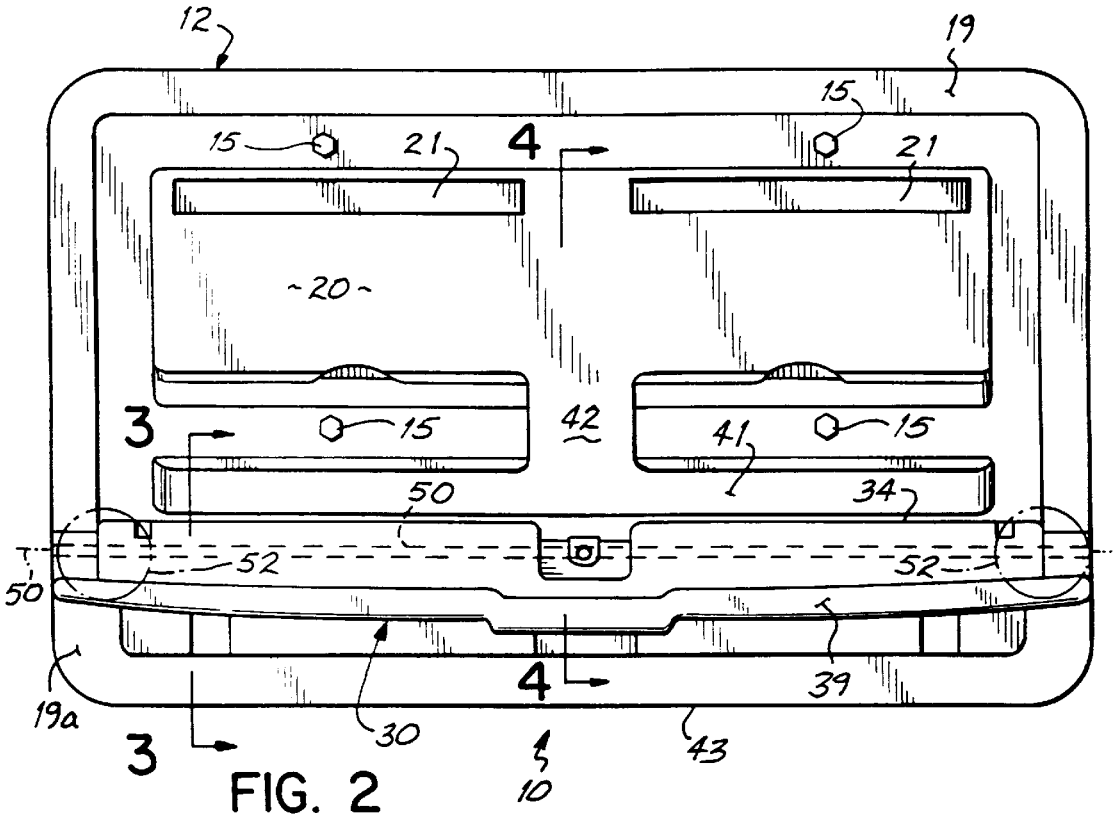
FIG. 2 is a front view of the station of FIG. 1 with the platform in an open position.

Referring to FIG. 1, flange 19 includes a step-up portion 19*a* which further defines the slot 44 of base 12 and provides a thicker portion of the flange 19. When the platform is closed, flange 40 on the platform 30 overlies flange 19 generally above the slot or slot portion 44 of the base 12. Preferably, the step-up portion 19*a* is of sufficient thickness to generally match the thickness of the overlying flanges 40 and 19 and thus provide a flush and flat look to the front and side of station 10 when it is in the closed position, as illustrated in FIGS. 1A, 3B, and 4B. As shown in FIG. 2, peripheral flange 40 overlies an upper portion of flange 19 but does not overly flange portion 19*a* in either the opened or closed position. In the opened position, the rear edge 45 is positioned proximate flange portion 19*a*.

The baby platform 30 of the invention is secured to base 12 generally horizontally when the platform is in the opened position. Platform 30 is prevented from rotating past the horizontal position to any great degree. In that way, the baby platform 30 will support the weight of a baby or older child having its diaper changed without substantial sagging below a horizontal position. The invention provides improved rigidity for that purpose. Referring to FIGS. 3A and 3B, platform 30 is hingedly coupled to base 12 by a metal hinge rod 50 which extends through base 12 and platform 30 as illustrated by reference numeral 50 in FIG. 2 (see also FIG. 1A). While the metal pivot rod 50 extends completely along the length of the station 10, the points of support for the platform 30 with respect to base 12 are generally indicated by reference circles 52 where the pivot rod 50 passes through both an end of the base 12 and an end of the platform 30. For the rest of the length of platform 30, the rod extends therethrough without contacting another portion of the base.

As illustrated in FIG. 3A, slot 44 receives the rear edge 45 of base 30 and is sufficiently dimensioned to allow for the base to be hinged or rotated between the opened position (FIG. 3A) and the closed position (FIG. 3B). Along the rear edge, the base 30 includes stop structures 54 which engage the lip 41 of base 12 when the platform is in the opened position. The stop structure resembles an up-struck tooth depending upwardly from the rear edge of the platform 30 (see FIG. 3A). Stop structure 54 includes a forward surface 55 which engages rearward surfaces 57 or mounting pads of the lip 41. The surfaces 57 are referred to and defined as mounting pads. In a preferred embodiment of the invention, all of the mounting pads are defined as parts of a continuous surface formed by lip 41; however, they may also be discreet surfaces formed individually for each stop structure 54. When the stop structure 54 engages lip 41, the base 30 is generally prevented from rotating any further horizontally than the opened position. The stop structure 54 provides a rigidity to the base 30 which is not achievable with the hinge structures which are conventionally used. The mounting pads 57 provide a wide surface for the stop structures 54 to engage. The surfaces 55 and 57 are disposed generally parallel to the base and the forces acting on those surfaces and the mounting pads 57 and stop structures are generally tensile in nature rather than compressive. Because the base 12 and platform 30 are formed of plastic, there will be some give or sag when the platform 30 is in the open position and the weight of the baby is placed thereon. However, the unique stop structures 54 and mounting pads 57 of the invention provide a rigidity which has not been achievable in the prior art. When platform 30 is moved to the closed position as illustrated in FIG. 3B, the stop structure 54 moves within a slot 58 formed in the base 12 so that the platform 30 may be moved to a flush, closed position (see FIG. 1A).

Figure 5A:
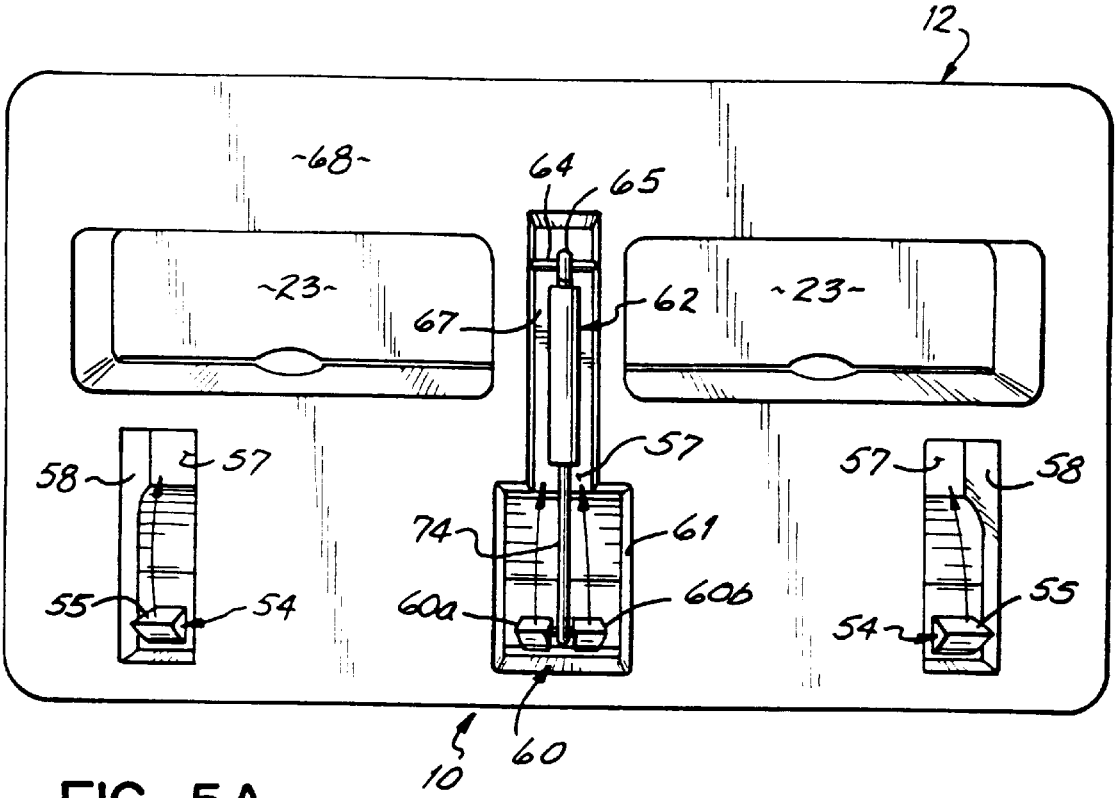
FIGS. 5A and 5B are rear view of the station of FIG. 1 in both the opened and closed positions respectively.
Figure 5B:
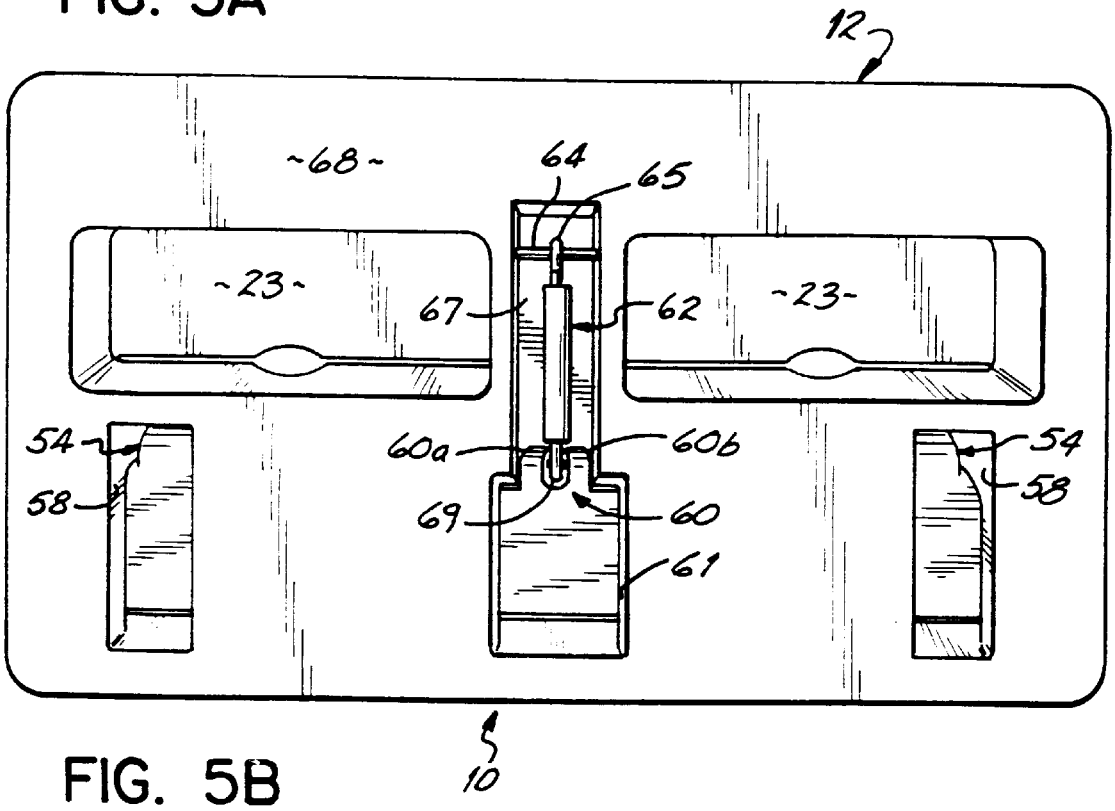

Referring to FIGS. 5A and 5B, the platform 30 includes at least two (2) stop structures, one positioned proximate either end of the platform. In a preferred embodiment of the invention, the platform includes approximately three (3) stop structures wherein one stop structure 60 is positioned proximate the middle of the platform between stop structures 54 and near one end of the closing cylinder 62 as discussed further hereinbelow.

Figure 4A:
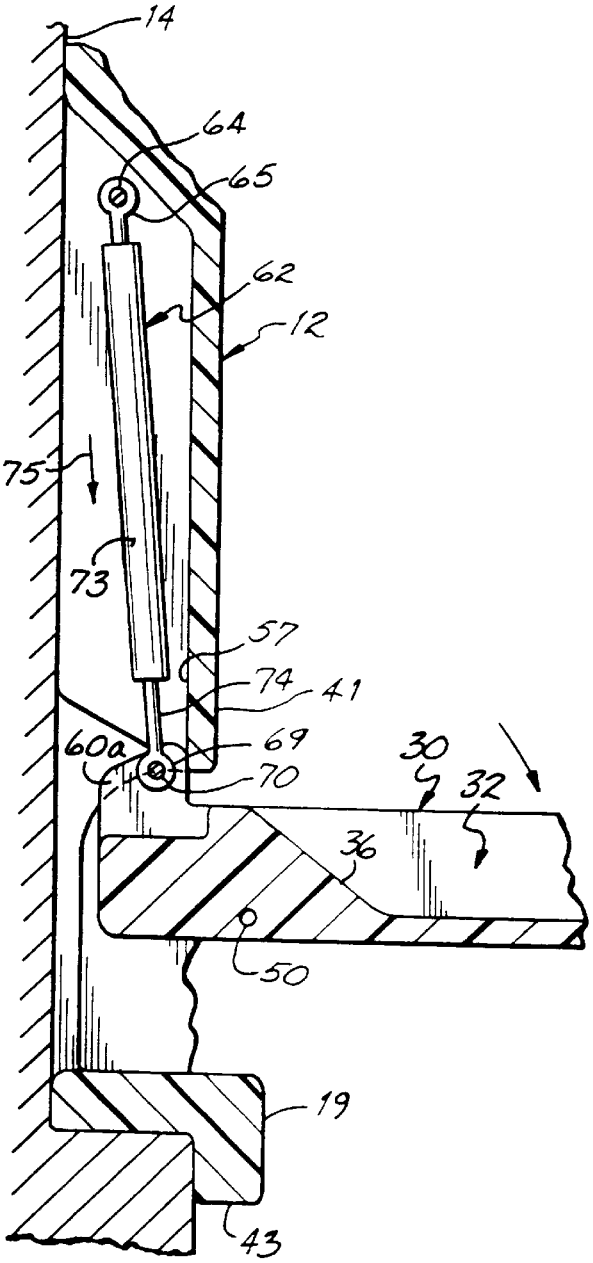
FIGS. 4A and 4B are cross-sectional views of FIG. 1 taken along lines 4—4, showing the platform in the opened and closed positions respectively.
Figure 4B:
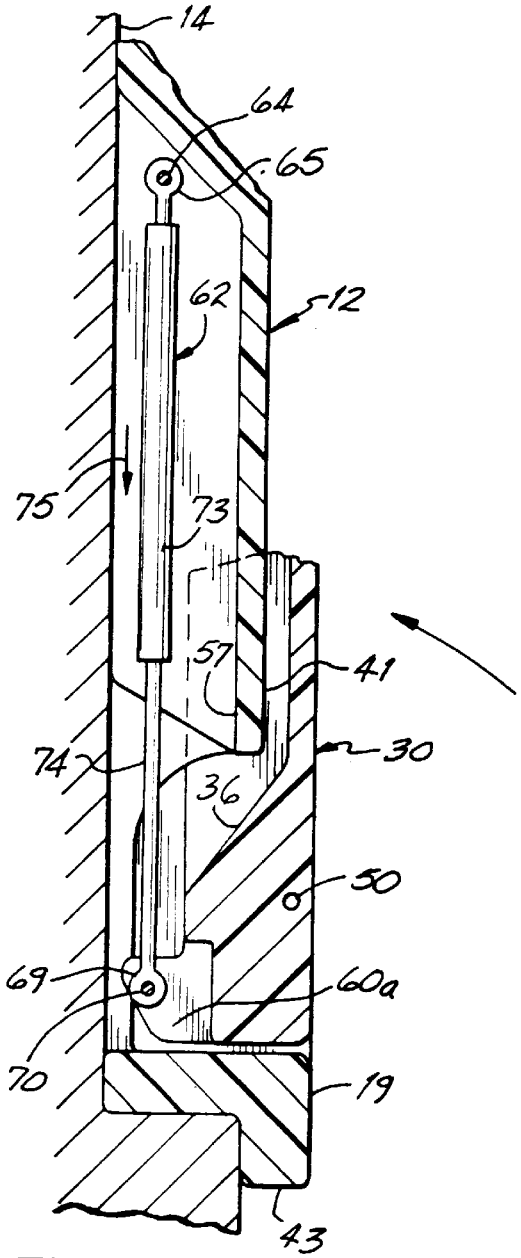

Referring to FIGS. 4A and 4B, the closing cylinder 62 of the invention is shown. The closing cylinder 62 is coupled at a top end thereof to base 12 by a pin 64. The end 65 of the cylinder rotates around pin 64. A slot 67 is formed in the rear surface 68 of base 12 for receiving the elongated cylinder 62. The opposite end 69 of cylinder 62 is coupled to platform 30 by another pin 70 which extends through stop structure 60. Stop structure 60 is in the form of two sections 60*a*, 60*b*, and the pin 70 extends therebetween and through end 69 of the cylinder, as illustrated in FIG. 5A. Cylinder 62 is a compressed air cylinder and includes a cylindrical body 73 and a piston 74 which moves within the body. Piston 74 is biased outwardly in the direction of arrow 75 and thus maintains platform 30 in the closed position when it is moved up against base 12 (see FIG. 4B). When platform 30 is moved to the opened position, as shown in FIGS. 4A and 4B, the piston 74 is compressed in the cylinder body 73 against biasing force 75. The biasing force 75 is insufficient to overcome the weight of the opened platform 30, especially if a baby is placed on the platform. Therefore, once platform 30 is opened, it will remain opened. However, when closing platform 30, a person using the station is assisted by the biasing force 75 of cylinder 62. In that way, the force needed to lift platform 30 to the closed position is lessened, making it easier to close the station. Furthermore, piston 74 moves within body 73 in a controlled manner so that when platform 30 is closed, it does not slam shut, but rather moves in a slow, controlled motion dictated by the operation of cylinder 62. As shown in FIGS. 5A and 5B, the elongated opening 67 for receiving cylinder 62 couples with the slot 61 formed to provide movement of the stop structures 60*a*, 60*b* when the platform is moved between the opened and closed positions. Referring to FIGS. 4A and 5B, when the platform is moved to the opened position, the stop structures 60*a*, 60*b* rest against mounting pads 57 which are formed by lip 41 generally along the length of the base 12. Three distinct mounting pad positions are shown for receiving the stop structures 54 and 60 in the embodiments illustrated in the FIGS. 1–5B. However, additional stop structures 54, 60 and mounting pads 57 may be added to baby platform 30 as needed for providing additional rigidity to the platform.

In accordance with another aspect of the present invention, baby diaper changing station 10 significantly reduces the number of cracks and crevices proximate platform 30 which might capture and accumulate dirt or other material and therefore be difficult to clean. Referring to FIG. 1, lip 41 extends generally along the length of base 12 and defines the various mounting pads 57 for receiving the stop structures as discussed above. The lip 41 extends forwardly from surface 18 of the base to cover a portion of the platform proximate the rear edge and also to cover the stop structures. Station 10 thus eliminates the plurality of slots formed by the various different hinge structures utilized in prior art stations. Lip 41 provides a smooth outside surface to clean proximate the surface 33 of trough 32 of platform 30. Most of the mess associated with changing a baby's diaper will be contained within the trough 32, but may also may migrate over to the bottom portion of base 30 proximate the lip 41. In the present invention, the outside lip 41 may be easily wiped down and is therefore substantially easier to clean than prior art diaper changing stations.

Furthermore, the unique combination of elements of the invention eliminates a visible hinge structure on the outside of station 10 when it is closed. Referring to FIG. 1A, a smooth, clean, and aesthetically pleasing design and profile of the station is provided at the front of the station. In the closed position, the bottom edge of the station is defined by flange portion 19*a* and not a hinge structure. Therefore, the present invention also eliminates crevices and openings on the outside of the station in the closed position which may accumulate dirt and other material from the rest room environment. The front surface of station 10 can be readily wiped clean and maintained.

Figure 6:
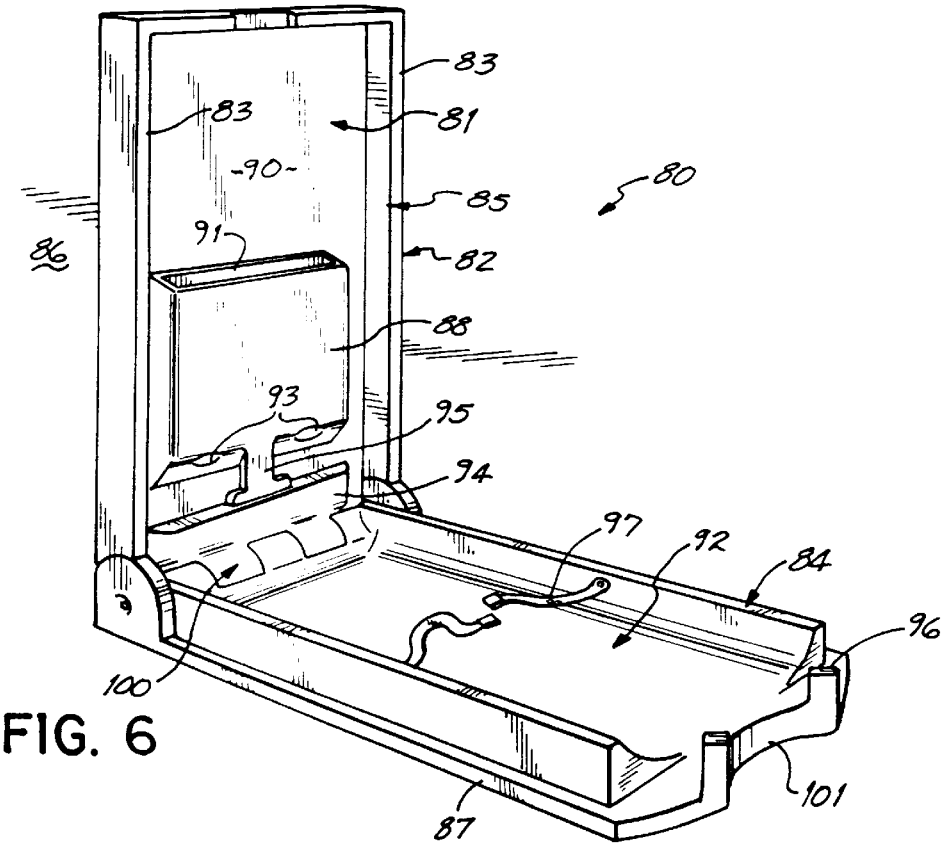
FIG. 6 is a perspective view of an alternative embodiment of the invention.

FIG. 6 illustrates another embodiment of the present invention wherein a baby will be positioned to lay with his feet or head facing away from the wall. Station 80 includes a base 82 and a platform 84 hingedly coupled to base 82. Platform 84 extends lengthwise away from the base whereas the platform 30 of station 10 extends lengthwise along the base. Base 82 forms a cavity 81 which has a sufficient depth for receiving baby platform 82 such that the platform lies generally flush against the base 82 in the closed position as discussed hereinabove with the other embodiment. The peripheral flange 85 extends around base 82 and defines sidewalls 83 which form cavity 81. The corresponding flange 87 around platform 84 lies flush against the flange 85 when the station 80 is in a closed position Station 80 is configured for being surface mounted to a wall 86.

Figure 7:
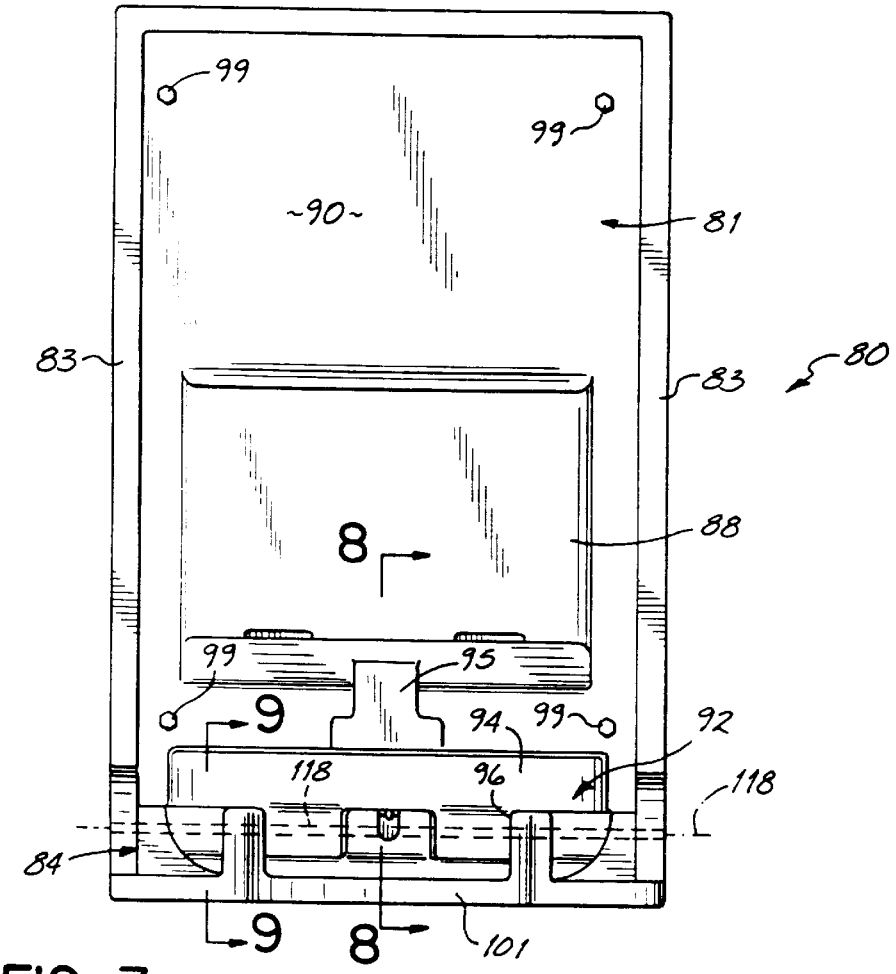
FIG. 7 is a front view of the embodiment in FIG. 6 with the platform in the opened position.
Figure 10:
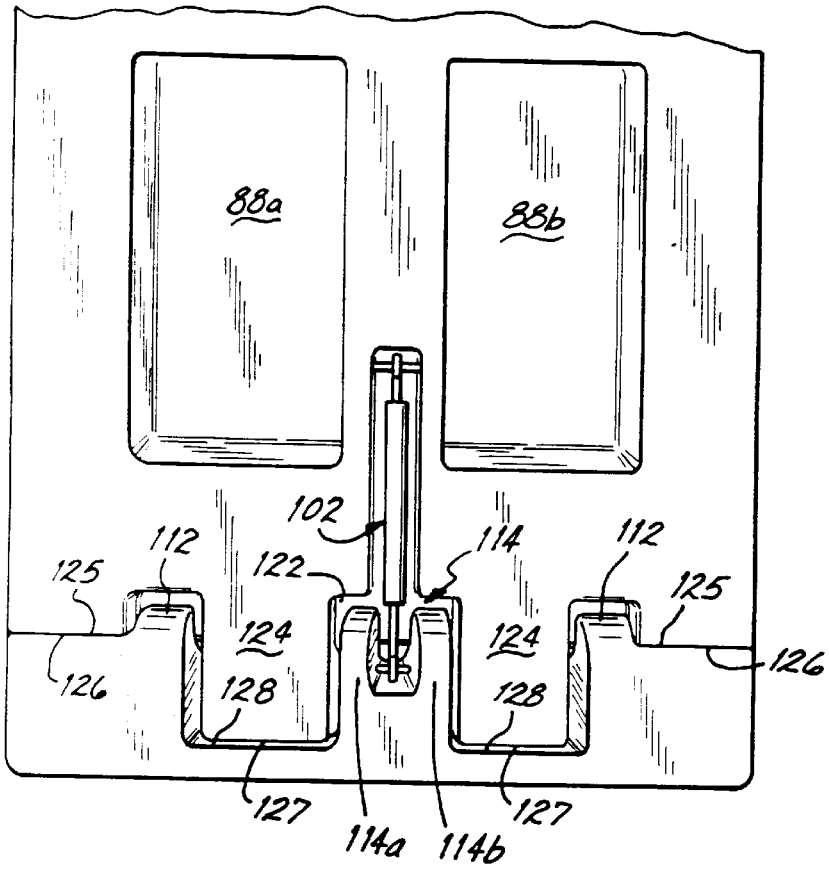
FIG. 10 is a rear view of the embodiment in FIG. 6 with the platform in the closed position.
Figure 11:
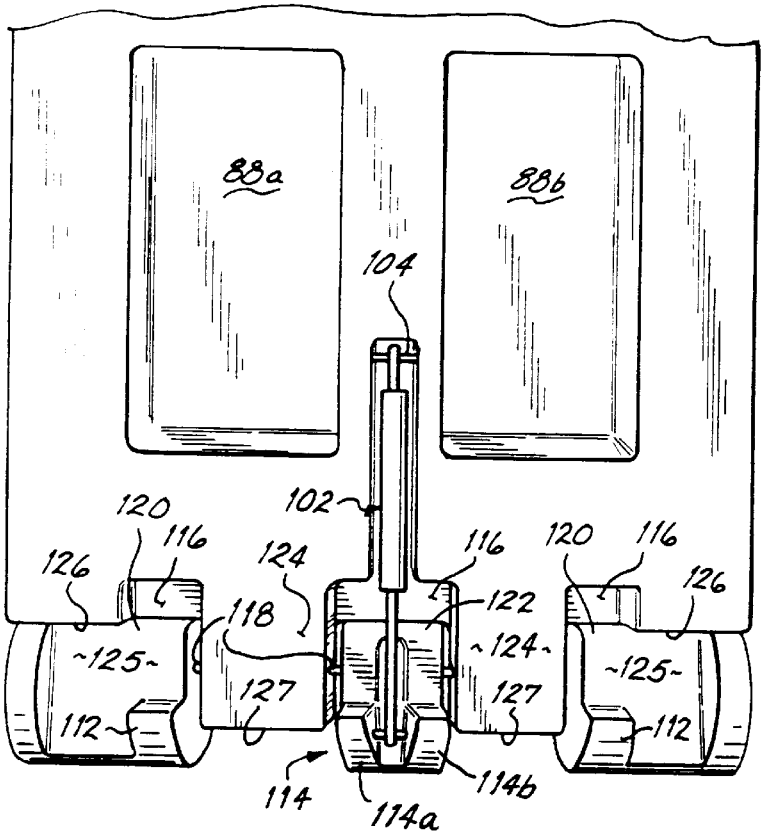
FIG. 11 is a rear view of the embodiment in FIG. 6 with the platform in the opened position.

A liner dispenser 88 is formed on base 82 and is raised from the front surface 90 of the base. As illustrated in FIGS. 10 and 11, the liner dispenser 80 includes two separate compartments 88*a*, 88*b* for dispensing liners and includes inlets 91 for loading the liners and outlets 93 for accessing the liners from the front of the station when it is in the opened position as shown in FIG. 6. A lip 94 is formed on base 82 proximate the lower edge of the base where it is hingedly coupled to platform 84. The lip defines mounting pads for stop structures in the base, as discussed further hereinbelow. A cylinder casing 95 extends between and is generally coextensive with the lip 94 and the liner dispenser 88 for containing and covering an opening cylinder coupled between the base 82 and baby platform 84. Utility hooks 96 are formed proximate the front edge of platform 84 for receiving a purse, diaper bag or similar item. A safety strap 97 is coupled at its ends to platform 84 for securing a child thereon. The child is generally disposed on platform 84 with its feet facing away from a wall surface. The base 82 is mounted to a wall surface by bolts 99 or other similar structures (see FIG. 7). Station 80 operates similarly to station 10 and baby platform 84 can be hinged between opened and closed positions with respect to base 82.

In station 80, the platform 84 is hingedly mounted to base 82 to enjoy the advantages of the present invention. More specifically, platform 84 is rigidly mounted to base 82 to reduce the sag of the platform below a generally horizontal position as illustrated in FIG. 6. Furthermore, when the platform is moved to a closed position, as illustrated in FIGS. 8B and 9B, a flat, and aesthetically pleasing front surface is provided which eliminates the visibility of any hinge structure and also provides a smooth surface for easy cleaning. As illustrated in FIG. 6, station 80 exposes a portion of a hinge structure 100 and thus may be slightly more susceptible to collecting material and dirt proximate the hinge structure. However, a baby on platform 84 will generally be positioned with its feet pointing away from the wall. Therefore, any mess associated with changing the diapers of a baby will be contained proximate the front edge 101 of the station. This is a substantially different situation than station 10 illustrated in FIG. 1 wherein the baby is positioned on the platform 30 such that one side of the baby is adjacent to the area where platform 30 is coupled to base 12.

Figure 8A:
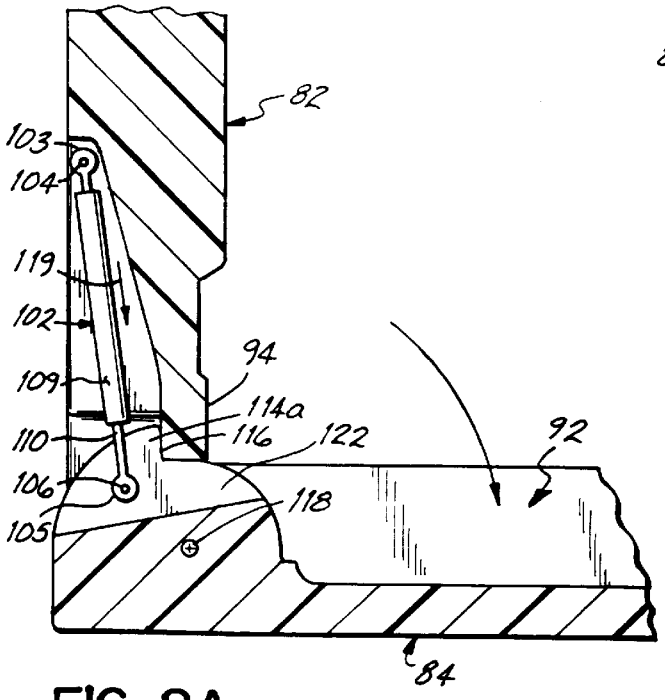
FIGS. 8A and 8B are cross-sectional views along lines 8—8 of FIG. 7 with the platform in the opened and closed positions, respectively.
Figure 8B:
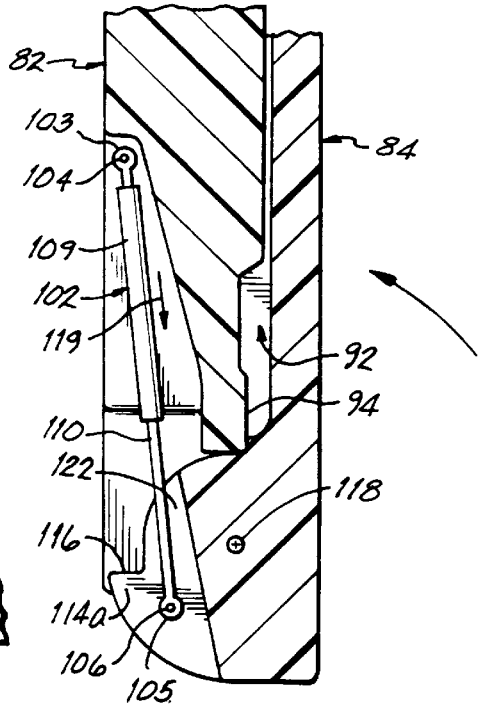
Figure 9A:
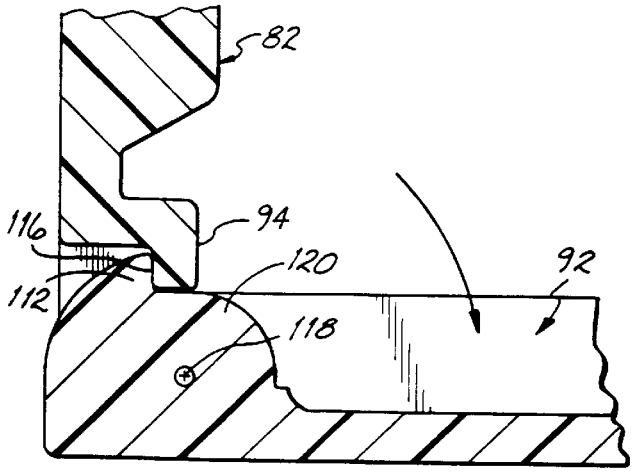
FIGS. 9A and 9B are cross-sectional views along lines 9—9 of FIG. 7 with the platform in the opened and closed positions, respectively.
Figure 9B:
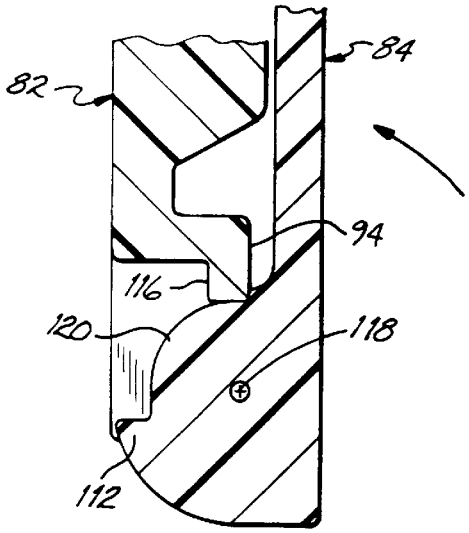

Referring to FIGS. 8A and 8B, the platform and base are shown in cross-section proximate an opening cylinder 102. An end 103 of the cylinder is coupled to base 82 through a pin 104 so that end 103 may pivot with respect to the base. The other end 105 of cylinder 102 is coupled through a pin 106 to the base for pivoting with respect to the base. Cylinder 102 includes cylinder body 109 and a piston 110 which moves in and out of the cylinder body. Referring to FIGS. 10 and 11, the base further includes stop structures 112, 114. The stop structure 114 might be considered as two portions 114*a*, 114*b*. Pin 105 extends between stop structures 114*a*, 114*b*. As discussed hereinabove, when platform 84 is moved into the opened position, the stop structures 112, 114 abut against mounting pads 116 defined in a rear surface of base 82 (see FIG. 10). In that way, platform 84 is rigidly secured in a generally horizontal position, thus eliminating sag associated with the weight of the platform 84, as well as the weight of the baby placed on the platform. The stop structures 112, 114 are positioned proximate the sides of the platform as well as the center of the platform for providing an even holding force across the width of the platform. FIGS. 9A and 9B show cross-sectional views wherein one of the outer stop structures 112 abuts against the mounting pad 116 formed by lip 94. As illustrated in FIG. 6, lip 94 extends generally across the width of platform 84 and forms and defines the various mounting pads 116. Lip 94 thus presents a rigid structure for securing the platform 84 in the opened position. For hinging, station 80 includes a metal hinge rod 118 which extends through the platform 84 and base 82 (see FIG. 7).

Similar to station 10, when station 80 is opened, the piston 110 is compressed into cylinder body 109 which creates a biasing force in direction of arrow 119. The biasing force enables the platform 84 to be easily closed.

The stop structures 112, 114 of platform 84 extend upwardly from the top surface 85 of the platform 84 which defines trough 92. In that way, when platform 84 is moved to the closed position, as illustrated in FIGS. 8B and 9B, the stop structures generally project rearwardly against the wall and are hidden from view from the front of the station. The bottom surface 89 of platform 84 is then exposed as a front surface of the closed station. Surface 89 is a flat and generally continuous and unbroken surface which is easily wiped clean, and which provides an aesthetically pleasing overall look to the station when it is in the closed position. The hinge structure 100 and various elements thereof which hingedly couple base 82 and platform 84 together are hidden from view. Thus the collection of dirt and other material by the hinge structures when the changing station 80 is in the closed position is reduced. Referring to FIGS. 6, 10, and 11, changing station 80 includes hinge portions associated with each of the base 82 and platform 84 for providing further strength and support where the base and platform are hingedly coupled together. To that end, portions of the base 82 and corresponding portions of the platform 84 interact to create the hinge structure 100. More specifically, platform 84 includes outer cylindrical portions 120 which define the stop structures 112 on a rear edge of the platform proximate either side of the platform. A center cylindrical portion 122 defines the stop structures 114*a*, 114*b* in their position proximate the longitudinal center of the platform 84 at the rear edge of the platform.

Correspondingly, the base portion of hinge structure 100 includes cylindrical portions 124 which are positioned between the outer portions 120 and the center portion 122 for completing the hinge structure 100. When platform 84 is in the opened position, as shown in FIG. 10, surfaces 125 formed by portions 120 abut against a downwardly directed face surface 126 of base 82. Simultaneously, downwardly directed surfaces 127 of base 82 rest against surfaces 128 defined by platform 84 generally between the stop structures 112 and 114. The interaction between surfaces 125,126 and 127, 128 provides additional support to platform 84 in the opened position. Therefore station 80 utilizes the interaction between the stop structures 112, 114 and the mounting pads 116, as well as the interaction between the surfaces 125, 126 and 127, 128 to provide support to platform 84 with respect to base 82. The extra support provided for by surfaces 125, 126 and 127, 128 addresses the elongated platform 34 and the moment forces thereon.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A wall-mounted station for changing the diapers of a baby comprising:

a base configured for being vertically mounted to a wall and defining a base plane;

a baby platform hingedly mounted to the base and defining a platform plane, the baby platform operable for being movable between an opened position wherein the platform plane is disposed generally perpendicular to the base plane for the platform to receive a baby and a closed position wherein the platform plane is generally parallel to the base plane;

stop structures extending from a rear edge of the baby platform proximate the base, the stop structures extending generally perpendicular to the platform plane;

mounting pads corresponding to the stop structures and positioned on the base and disposed generally parallel to the base plane;

the stop structures operable for abutting in a co-extensive fashion against the corresponding mounting pads and disposed generally parallel to the base plane when the baby platform is moved to an open position;

the stop structures and corresponding mounting pads being positioned at spaced positions along the length of the station with a stop structure and corresponding mounting pad proximate each end of the station and a stop structure and corresponding mounting pad proximate the center of the station to provide even distribution of support of the platform along its length against the base and maintain the baby platform perpendicular to the base when the weight of a baby is placed thereon.

2. The station of claim 1 wherein said mounting pads are all formed by a generally continuous surface.

3. The station of claim 1 wherein the base includes a lip extending forwardly of a front surface of the base, the lip defining said mounting pads and configured to cover the stop structures when the stop structures abut the mounting pads to reduce crevices proximate the baby platform which might capture dirt.

4. The station of claim 1 further comprising a cylinder coupled between the base and platform to assist in the movement of the platform between the opened and the closed positions, a stop structure and mounting pad being positioned directly proximate the cylinder for providing support of the platform near the cylinder.

5. The station of claim 4 further comprising a stop structure and corresponding mounting pad positioned on opposite sides of the cylinder for providing support of the platform on both sides of the cylinder.

* * * * *

UNITED STATES PATENT AND TRADEMARK OFFICE

CERTIFICATE OF CORRECTION

PATENT NO. : 6,055,688
DATED : May 2, 2000
INVENTOR(S) : John A. Helmsderfer et al.

It is certified that error appears in the above-identified patent and that said Letters Patent is hereby corrected as shown below:

Column 1,
Line 24, delete material beginning "difficult to adequately ...."
up to and including line 53 "... does not want to spend". Insert the deleted material starting in Column 2, line 17 after "stations find it".

Signed and Sealed this

Twentieth Day of November, 2001

*Attest:*

Nicholas P. Godici

*Attesting Officer*

NICHOLAS P. GODICI
*Acting Director of the United States Patent and Trademark Office*